US007086380B2

(12) United States Patent
Mukasa et al.

(10) Patent No.: US 7,086,380 B2
(45) Date of Patent: Aug. 8, 2006

(54) APPARATUS FOR CONTROLLING THROTTLE VALVE OF INTERNAL COMBUSTION ENGINE

(75) Inventors: Tamikazu Mukasa, Tochigi (JP); Hiromichi Kobayashi, Tochigi (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 11/167,101

(22) Filed: Jun. 28, 2005

(65) Prior Publication Data

US 2006/0000444 A1 Jan. 5, 2006

(30) Foreign Application Priority Data

Jun. 30, 2004 (JP) ..... 2004-192988

(51) Int. Cl.
*F02D 11/10* (2006.01)

(52) U.S. Cl. ..... 123/399

(58) Field of Classification Search ..... 123/361, 123/396, 399; 318/254
See application file for complete search history.

(56) References Cited

FOREIGN PATENT DOCUMENTS

| | | | |
|---|---|---|---|
| JP | 2000-156989 | | 6/2000 |
| JP | 2005113767 | * | 4/2005 |

* cited by examiner

*Primary Examiner*—T. M. Argenbright
(74) *Attorney, Agent, or Firm*—Westerman, Hattori, Daniels & Adrian, LLP.

(57) ABSTRACT

An apparatus for controlling an opening degree of a throttle valve of an internal combustion engine using a DC motor, in which a real opening degree of the throttle valve is detected, a target opening degree of the throttle valve is set in accordance with an operation state of the internal combustion engine, an output voltage of a DC power source is boosted, and one voltage of the boosted voltage and the output voltage of the DC power source is selected in accordance with an opening degree difference between the real opening degree and the target opening degree to apply the selected one voltage to the DC motor.

6 Claims, 5 Drawing Sheets

APPARATUS FOR CONTROLLING THROTTLE VALVE OF INTERNAL COMBUSTION ENGINE

BACKGROUND OF THE INVENTION

1. Field of the Invention

The present invention relates to a throttle valve controlling apparatus of a motor drive type for opening/closing-driving a throttle valve of an internal combustion engine through a DC (direct current) motor.

2. Description of the Related Background Art

In a conventional throttle valve controlling apparatus of a motor drive type, an accelerator opening degree sensor for detecting a stepping-in amount (accelerator opening degree) of an accelerator pedal, a throttle valve opening degree sensor for detecting a real opening degree of a throttle valve, a DC motor for driving the throttle valve, and a controlling circuit for controlling rotation of the motor are provided (see, for example, Japanese Patent Application Kokai No. 2000-156989). The conventional apparatus sets a target throttle valve opening degree corresponding to the accelerator opening degree detected by the accelerator opening degree sensor, sets a duty ratio based on the difference between the target throttle valve opening degree and the real throttle valve opening degree detected by the throttle valve opening degree sensor, and drives the motor at the set duty ratio. The motor is supplied with a current corresponding to the duty ratio, so that the throttle valve is driven to decrease the difference between the target throttle valve opening degree and the real throttle valve opening degree.

In the conventional throttle valve controlling apparatus, as the DC motor, one which is capable to sufficiently obtain torque required to open or close the throttle valve in a transition operation state such as hard acceleration and hard deceleration of the internal combustion engine is usually used. However, since a DC motor which can satisfy such a condition becomes relatively large, there is a problem that it is difficult to downsize the throttle valve controlling apparatus.

SUMMARY OF THE INVENTION

Then, an object of the present invention is to provide a throttle valve controlling apparatus which can downsize itself and properly open or close a throttle valve even when the internal combustion engine is in a transition operation state.

According to the invention, there is provided an apparatus for controlling an opening degree of a throttle valve of an internal combustion engine by giving rotary power of a DC motor to the throttle valve, comprising: detecting means for detecting a real opening degree of the throttle valve; target opening degree setting means for setting a target opening degree of the throttle valve in accordance with an operation state of the internal combustion engine; boosting means for boosting an output voltage of a DC power source; and drive controlling means for selecting one voltage of an output voltage of the boosting means and the output voltage of the DC power source in accordance with an opening degree difference between the real opening degree and the target opening degree, and applying the selected one voltage to the DC motor.

BRIEF DESCRIPTION OF THE DRAWINGS

FIG. 3 is a diagram showing operation of each portion of an apparatus in a period immediately after that an ignition switch is turned on;

DETAILED DESCRIPTION OF THE INVENTION

An embodiment of the present invention will be hereinafter explained in detail with reference to the accompanying drawings.

Figure 1:
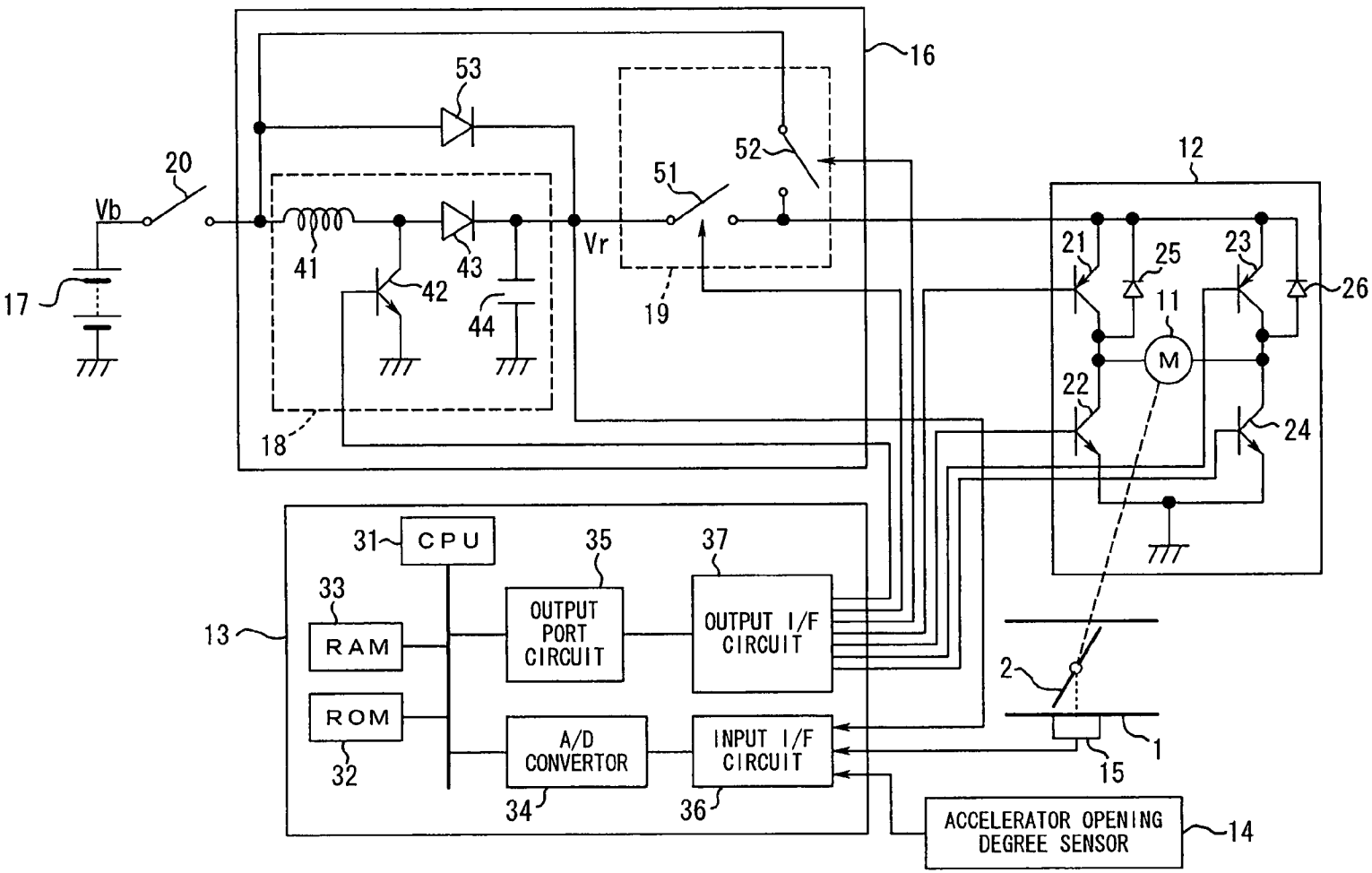
FIG. 1 is a block diagram showing an embodiment of the present invention.

FIG. 1 shows a throttle valve controlling apparatus of a motor drive type according to the present invention. The throttle valve controlling apparatus is an apparatus for controlling the opening degree of a throttle valve 2 in an intake pipe 1 of an internal combustion engine mounted in a vehicle, and comprises a DC motor 11, a driver 12, a controller 13, an accelerator opening degree sensor 14, a throttle valve degree sensor 15, and a power supply circuit 16.

The DC motor 11 drives the throttle valve 2 to change the opening degree, and the drive of the throttle valve 2 is controlled by the controller 13 through the driver 12.

The driver 12 includes four transistors 21 to 24, and diodes 25 and 26. The transistors 21 and 23 are PNP type transistors, and the transistors 22 and 24 are NPN type transistors. The collectors of the transistors 21 and 22 are connected to the positive terminal of the DC motor 11, the collectors of the transistors 23 and 24 are connected to the negative terminal of the DC motor 11. The emitters of the transistors 21 and 23 are formed as an input of the driver 12, are connected to the output of the power supply circuit 16. The emitters of the transistors 22 and 24 are grounded. The bases of the transistors 21 to 24 are connected to the controller 13. The diode 25 is connected between the emitter and the collector of the transistor 21, and the diode 26 is connected between the emitter and the collector of the transistor 23.

The controller 13 includes a CPU (central processing unit) 31, a ROM (read only memory) 32, a RAM (random access memory) 33, an A/D (analog/digital) convertor 34, an output port circuit 35, an input interface circuit 36, and an output interface circuit 37. The CPU 31, the ROM 32, the RAM 33, the A/D convertor 34, and the output port circuit 35 are connected in common by a bus. The CPU 31 executes a throttle valve controlling operation to control the opening degree of the throttle valve 2. The A/D convertor 34 is connected to the input interface circuit 36. The output port circuit 35 is connected to the output interface circuit 37.

The accelerator opening degree sensor 14 detects a stepping-in amount (accelerator opening degree) of an accelerator pedal of the vehicle to generate a voltage signal based on the accelerator opening degree.

The throttle valve degree sensor 15 detects a real opening degree of the throttle valve 12 to generate a voltage signal based on the real opening degree.

The power supply circuit 16 has a boosting circuit 18 and a switching circuit 19. The boosting circuit 18 is a circuit for boosting an output voltage Vb (for example, 12 V) of a DC power source 17, and has a coil 41, a switching transistor 42, a diode 43, and a capacitor 44.

The power source 17 is a battery for outputting the voltage Vb which is an approximate constant voltage. The positive terminal of the power source 17 is connected to the power supply circuit 16 through an ignition switch 20, and the negative terminal is grounded.

One end of the coil 41 is connected to the positive terminal of the power source 17 and functions as an input of the boosting circuit 18, and the other end of the coil 41 is connected to the anode of the diode 43. The cathode of the diode 43 is grounded through the capacitor 44 and functions as an output of the boosting circuit 18. The connecting line between the coil 41 and the anode of the diode 43 is connected to the collector of the transistor 42. The emitter of the transistor 42 is grounded. The base of the transistor 42 is connected to the output interface circuit 37. The coil 42 generates a boosted voltage Vr when the transistor 42 repeats turning-on/off. The boosted voltage Vr is applied to the capacitor 44 to charge the capacitor 44.

The switching circuit 19 selectively supplies one of the output voltage Vb of the power source 17 and the boosted voltage Vr of the boosting circuit 18 to the driver 12 in accordance with control by the controller 13. The switching circuit 19 has two switching elements 51 and 52. One end of the switching element 51 is connected to the output of the boosting circuit 18, and one end of the switching element 52 is connected to the positive terminal of the power source 17. The other ends of the switching elements 51 and 52 are connected to the input of the driver 12. Each of the switching elements 51 and 52 has a control end which is connected to the output interface circuit 37, so as to turn on/off in response to an instruction from the CPU 31.

In the power supply circuit 16, the diode 53 is arranged between the input and the output of the boosting circuit 18. The diode 53 is applied the output voltage Vb of the power source 17 to the capacitor 44 in the boosting circuit 18 when the ignition switch 20 is turned on.

The input interface circuit 36 of the controller 13 is supplied with the output voltage Vr, the output signal of the accelerator opening degree sensor 14, and the output signal of the throttle valve degree sensor 15. Each of these voltage and signals supplied to the input interface circuit 36 is selectively converted into a digital signal by the A/D convertor 34. The digital signal is supplied to the CPU 31, so that the CPU 31 can read the output voltage Vr of the boosting circuit 18, the accelerator opening degree, and the real opening degree of the throttle valve 2.

The CPU 31 controls on/off of the transistor 42 of the boosting circuit 18, on/off of each of the switching elements of the switching circuit 19, and on/off of each of the transistors 21 to 24 of the driver 12 by executing the above throttle valve controlling operation. A control instruction for each of the on/off operations is supplied to the transistor or element from the CPU 31 through the output port circuit 35 and the output interface circuit 37. By controlling at a duty ratio the on/off operations of the transistors 21 to 24 in the driver 12, a current supplied to the motor 11 is controlled, so that the opening degree of the throttle valve 2 is controlled.

In the throttle valve controlling apparatus with the above structure, the CPU 31 repeatedly executes the throttle valve controlling operation for each predetermined period Tc. The predetermined period Tc is equal to a duty cycle in the duty ratio control.

Figure 2:
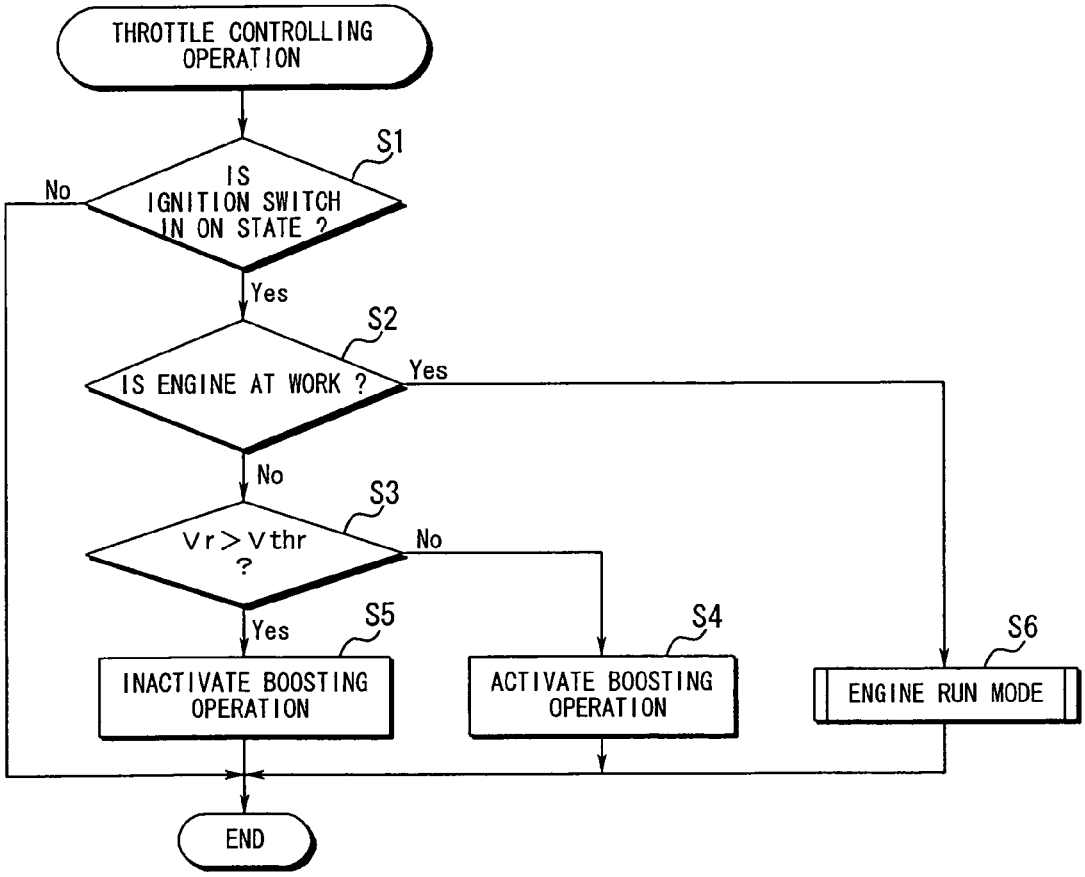
FIG. 2 is a flowchart showing a throttle valve controlling operation.

In the throttle valve controlling operation, as shown in FIG. 2, the CPU 31 determines whether or not the ignition switch 20 of the vehicle is turned on (step S1). If the ignition switch 20 is turned off, the CPU 31 ends the throttle valve controlling operation soon. If the ignition switch 20 is turned on, the CPU 31 determines whether or not the internal combustion engine is at work (step S2). A rotational speed sensor for detecting a rotational speed of the internal combustion engine is not shown in FIG. 1. However, when the rotational speed detected by the rotational speed sensor is higher than or equal to a predetermined speed (for example, 500 rpm), it can be determined that the internal combustion engine is at work.

When the internal combustion engine is not at work, the CPU 31 determines whether or not the output voltage Vr of the boosting circuit 18 is higher than or equal to a threshold voltage Vthr (step S3). The threshold voltage Vthr is a voltage higher than the output voltage Vb of the power source 17. If $Vr \leqq Vthr$, the CPU 31 supplies a boost switching signal to the transistor 42 of the boosting circuit 18 to activate the boosting circuit 18 (step S4). If $Vr > Vthr$, which indicates that the output voltage Vr of the boosting circuit 18 is sufficiently high, the CPU 31 stops the supply of the boost switching signal to inactivate the boosting circuit 18 (step S5).

Figure 3:
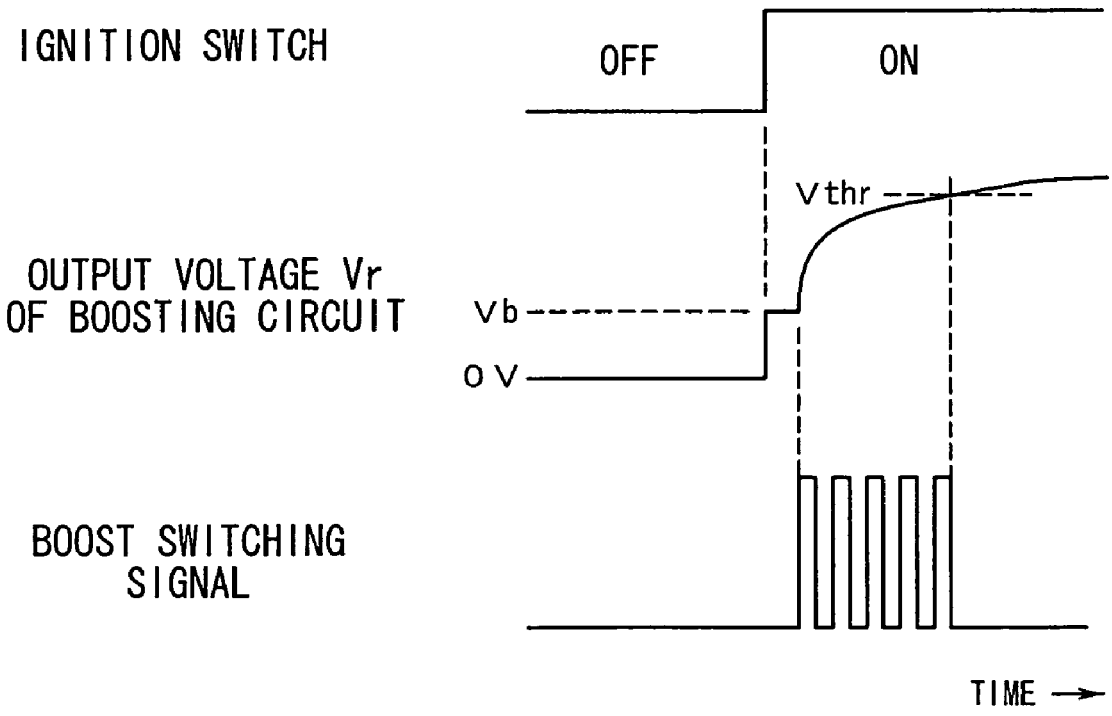

As shown in FIG. 3, when the ignition switch 20 is turned on, the boost switching signal is supplied to the base of the transistor 42, so that the transistor 42 repeats on/off in accordance with the boost switching signal. Thus, the output voltage Vr of the boosting circuit 18 is equal to the output voltage Vb of the power source 17 immediately after that the ignition switch 20 has been turned on, and gradually increases with a lapse of time due to the boosting operation by the repeated on/off of the transistor 42. When the output voltage Vr of the boosting circuit 18 is higher than the threshold voltage Vthr, the supply of the boost switching signal to the base of the transistor 42 is stopped, so that the boosting circuit 18 stops the boosting operation.

If a result of the determination at step S2 indicates that the internal combustion engine is at work, an engine run mode is started in the CPU 31 (step S6).

Figure 4:
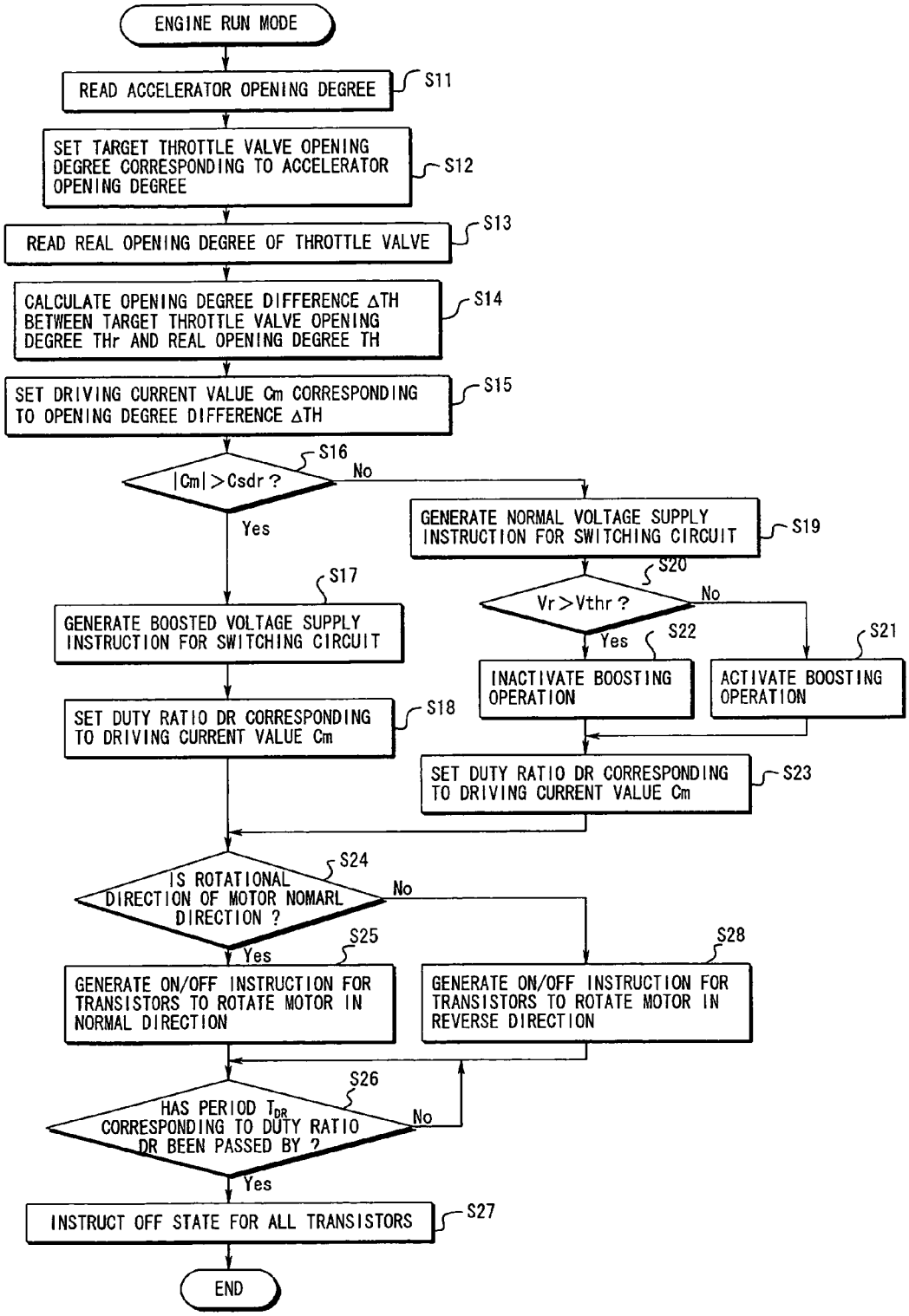
FIG. 4 is a flowchart showing an engine run mode operation.

In the engine run mode, as shown in FIG. 4, the CPU 31 reads an accelerator opening degree detected by the accelerator opening degree sensor 14 (step S11), and sets a target throttle valve opening degree THr corresponding to the accelerator opening degree detected (step S12). The target throttle valve opening degree THr at step S12 is set by reading data of THr corresponding to the detected accelerator opening degree using a data table for setting THr which is previously formed in the ROM 32, for example. The CPU 31 reads a real opening degree TH of the throttle valve 12 detected by the throttle valve degree sensor 15 (step S13), and calculates an opening degree difference $\Delta TH = THr - TH$ between the target throttle valve opening degree THr and the real opening degree TH (step S14). Further, the CPU 31 sets a driving current value Cm for the motor 11 based on the opening degree difference ΔTH (step S15). The driving current value Cm at step S15 is set by reading data of Cm corresponding to the calculated opening degree difference ΔTH using a data table for setting Cm which is previously formed in the ROM 32, for example. The larger the opening degree difference ΔTH becomes, the higher the driving current value Cm is set.

The CPU 31 determines whether or not the magnitude $|Cm|$ of the driving current value Cm set at step S15 is larger than a switching determination current value (predetermined threshold) Csdr (step S16). The switching determination current value is previously set. If $|Cm| > Csdr$, which means the time the motor 11 is driven by a boosted voltage, the CPU 31 generates a boosted voltage supply instruction for the switching circuit 19 (step S17). In the switching circuit 19, the switching element 51 turns on and the switching element 52 turns off in response to the boosted voltage supply instruction. Thus, the output voltage Vr is supplied to the driver 12 through the switching element 51.

The CPU 31 sets a duty ratio DR corresponding to the driving current value Cm (step S18), after executing step S17. The duty ratio DR indicates a period for which the driving current value Cm can be obtain averagely in the duty cycle by applying the output voltage Vr of the boosting circuit 18 to the motor 11. The duty ratio DR can be also set using a duty ratio setting data table for Vr which is previously formed in the ROM 32, for example.

If a result of the determination at step S16 indicates |Cm|<Csdr, which means the time the motor 11 is driven by a normal voltage, the CPU 31 generates a normal voltage supply instruction for the switching circuit 19 (step S19). In the switching circuit 19, the switching element 51 turns off and the switching element 52 turns on in response to the normal voltage supply instruction. Thus, the output voltage Vb of the power source 17 is supplied to the driver 12 through the switching element 52.

The CPU 31 determines whether or not the output voltage Vr of the boosting circuit 18 is higher than the threshold voltage Vthr (step S20), after executing the step S19. If Vr<Vthr, the CPU 31 supplies a boost switching signal to the transistor 42 of the boosting circuit 18 to activate the boosting circuit 18 (step S21). On the other hand, If Vr>Vthr, which means that the output voltage of the boosting circuit 18 is adequately high, the CPU 31 stops the supply of the boost switching signal to inactivate the boosting circuit 18 (step S22). The steps S20 to S22 are equal to the above steps S2 to S4.

The CPU 31 sets a duty ratio DR corresponding to the driving current value Cm (step S23), after executing step S21 or S22. The duty ratio DR at step S23 indicates a period for which the driving current value Cm can be obtain averagely in the duty cycle by applying the output voltage Vb of the power source 17 to the motor 11. The duty ratio DR can be also set using a duty ratio setting data table for Vb which is previously formed in the ROM 32, for example.

The CPU 31 judges the rotational direction of the motor 11 in accordance with the polarity of the opening degree difference ΔTH (step S24). If the opening degree difference ΔTH is positive, the CPU 31 instructs an on state for the transistors 21 and 24, and an off state for the transistors 22 and 23 to rotate the motor 11 in the normal direction (step S25). After that, the CPU 31 determines whether or not a period $T_{DR}$=Tc×DR corresponding to the duty ratio DR has been passed by (step S26). Tc indicates the above duty cycle. If the period $T_{DR}$ has been passed by, the CPU 31 instructs an off state for the transistors 21 to 24 (step S27). On the other hand, If the opening degree difference ΔTH is negative, the CPU 31 instructs an off state for the transistors 21 and 24, and an on state for the transistors 22 and 23 to rotate the motor 11 in the reverse direction (step S28). After executing step S28, the CPU 31 determines whether or not the period $T_{DR}$=Tc×DR corresponding to the duty ratio DR has been passed by at step S26. If the period $T_{DR}$ has been passed by, the CPU 31 instructs the off state for the transistors 21 to 24 at step S27.

The output interface circuit 37 allows the transistors 21 to 24 to turn on or off in response to the on instruction or off instruction for the transistors 21 to 24 from the CPU 31. In response to the on/off instructions of step S25, when the transistors 21 and 24 turn on, and the transistors 22 and 23 turn off, a driving current from the power supply circuit 16 flows into the ground through the transistor 21, the DC motor 11, and transistor 24 in that order. Thus, the motor 11 rotates in the normal direction to move the throttle valve 12 in the opening direction. On the other hand, in response to the on/off instructions of step S28, when the transistors 21 and 24 turn off, and the transistors 22 and 23 turn on, the driving current from the power supply circuit 16 flows into the ground through the transistor 23, the DC motor 11, and transistor 22 in that order. Thus, the motor 11 rotates in the reverse direction to move the throttle valve 12 in the closing direction.

For example, when the internal combustion engine operates under hard acceleration or hard deceleration, |Cm|>Csdr is satisfied, and motor 11 becomes a boosted driving state. In the boosted driving state, the switching element 51 of the switching circuit 19 turns on and the switching element 52 of the switching circuit 19 turns off in the power supply circuit 16, so that a driving current based on the output voltage Vr of the boosting circuit 18 is supplied to the motor 11 through the switching element 51.

When the internal combustion engine is under a steady operation state, |Cm|≦Csdr is satisfied, and motor 11 becomes a normal driving state. In the normal driving state, the switching element 51 of the switching circuit 19 turns off and the switching element 52 of the switching circuit 19 turns on in the power supply circuit 16, so that a driving current based on the output voltage Vb of the power source 17 is supplied to the motor 11 through the switching element 52.

Figure 5:
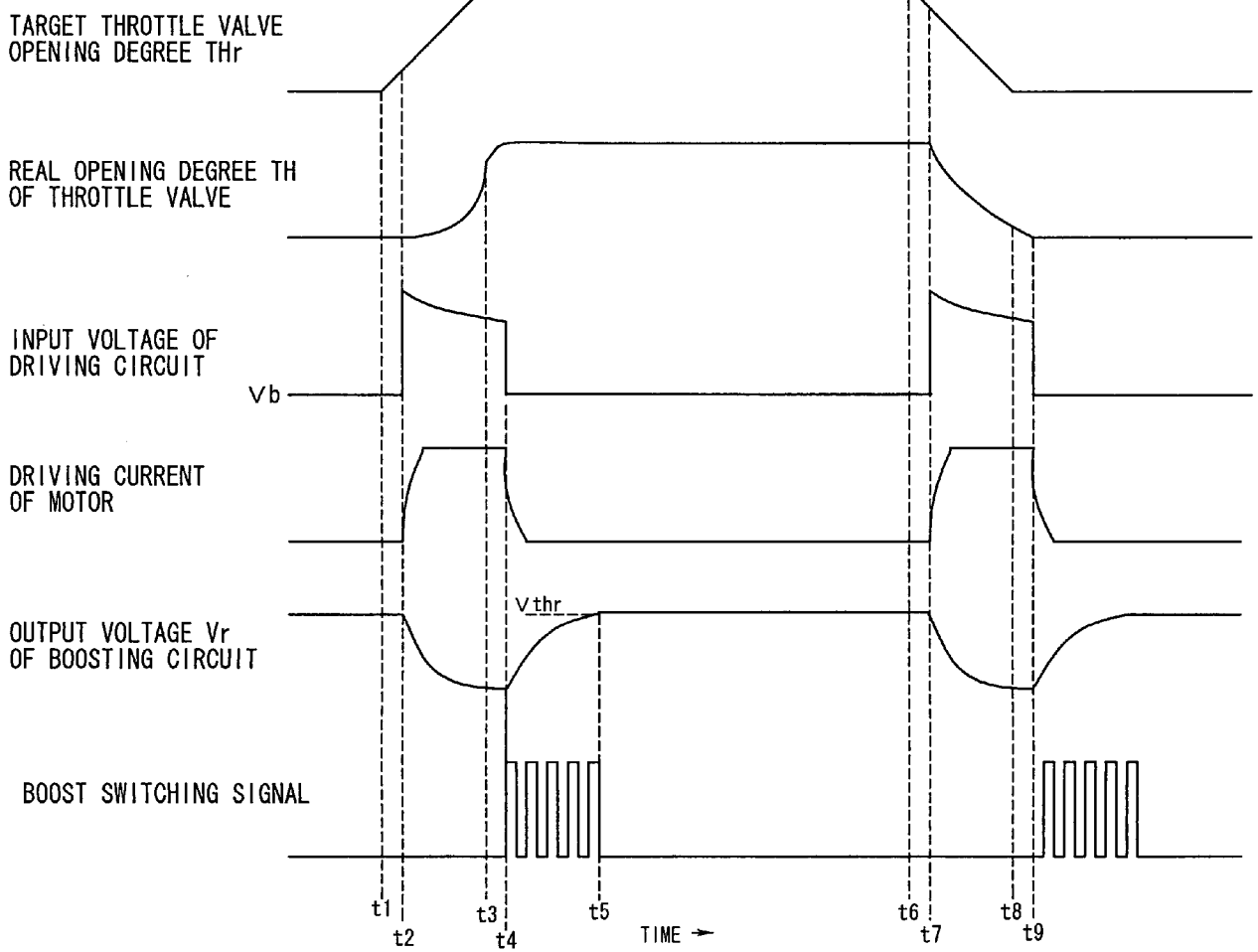
FIG. 5 is a diagram showing operation of each portion of the apparatus in an engine run mode.

FIG. 5 shows an operation example of each portion in the throttle valve controlling apparatus when the target throttle valve opening degree THr quickly changes in the opening direction, and after that, quickly changes in the closing direction. The target throttle valve opening degree THr starts changing in the opening direction at a time t1, and since |Cm|>Csdr is determined at a time t2, the apparatus changes into the boosted driving state of the motor 11. In the boosted driving state of the motor 11, the driving voltage of the motor 11 is equal to the output voltage Vr of the boosting circuit 18, and the driving current of the motor 11 becomes a current corresponding to the duty ratio DR set at step S18. Thus, the motor 11 rotates in the normal direction to move the throttle valve 12 in the opening direction. Since the driving current flows into the motor 11, the output voltage Vr of the boosting circuit 18 decreases gradually. The motor 11 rotates in the reverse direction at a time t3. Since |Cm|≦Csdr is determined at a time t4, the apparatus changes into the normal driving state of the motor 11. In the normal driving state of the motor 11, the driving voltage of the motor 11 is equal to the output voltage Vb of the power source 17, and the driving current of the motor 11 becomes a current corresponding to the duty ratio DR set at step S23. At that time, if the output voltage Vr of the boosting circuit 18 is lower than the threshold voltage Vthr, as shown in FIG. 5, as a result of the boosted driving of the motor 11, a boost switching signal is supplied to the base of the transistor 42. The transistor 42 repeats on/off in accordance with the boost switching signal. Thus, the output voltage Vr of the boosting circuit 18 gradually increases with a lapse of time. When the output voltage Vr of the boosting circuit 18 is higher than the threshold voltage Vthr at a time t5, the supply of the boost switching signal to the base of the transistor 42 is stopped, so that the boosting circuit 18 stops the boosting operation.

Similarly, the target throttle valve opening degree THr starts changing in the closing direction at a time t6, and since |Cm|>Csdr is determined at a time t7, the apparatus changes into the boosted driving state of the motor 11. The rotational direction of motor 11 is reversed at a time t8. Since |Cm|≦Csdr is determined at a time t9, the apparatus changes into the normal driving state of the motor 11. At that time, the transistor 42 repeats on/off in accordance with the boost switching signal. Thus, the output voltage Vr of the boosting circuit 18 gradually increases with a lapse of time.

In the above embodiment, the opening degree difference ΔTH between the target throttle valve opening degree THr and the real opening degree TH is calculated, the driving current Cm of the motor 11 is set in accordance with the opening degree difference ΔTH, and then it is determined whether or not the magnitude |Cm| of the driving current value Cm is larger than the switching determination current value Csdr. However, one of the boosted driving state and the normal driving state can be selected by determining whether or not the magnitude |ΔTH| of the opening degree difference ΔTH is larger than a switching determination value THsdr. Although the duty ratio DR is set in accordance with the driving current value Cm of the motor 11 in the above embodiment, the duty ratio DR can be set in accordance with the opening degree difference ΔTH. Further, the structure of the boosting circuit 18 is not limited to that of the above embodiment.

Although the target throttle valve opening degree THr is set in accordance with the stepping-in amount of the accelerator pedal in the above embodiment, the target throttle valve opening degree THr can be set in accordance with another engine parameter such as an engine rotational speed without limiting to the stepping-in amount.

As described above, according to the present invention, one voltage of the output voltage of the boosting means and the output voltage of a DC power source is selectively applied to the DC motor in accordance with the difference between the real opening degree and the target opening degree of the throttle valve. Therefore, since the DC motor of small size can be used, the apparatus can be downsized and dropped in cost. By using the small DC motor, the apparatus can have flexibility in mounting into a vehicle. Further, since the output voltage of the boosting means can be applied to the DC motor at a transition state of the internal combustion engine, it is possible to sufficiently obtain torque for quickly opening or closing the throttle valve.

What is claimed is:

1. An apparatus for controlling an opening degree of a throttle valve of an internal combustion engine by giving rotary power of a DC (direct current) motor to said throttle valve, comprising:

detecting means for detecting a real opening degree of said throttle valve;

target opening degree setting means for setting a target opening degree of said throttle valve in accordance with an operation state of said internal combustion engine;

boosting means for boosting an output voltage of a DC power source; and drive controlling means for selecting one voltage of an output voltage of said boosting means and the output voltage of said DC power source in accordance with an opening degree difference between the real opening degree and the target opening degree, and applying the selected one voltage to said DC motor.

2. An apparatus according to claim 1, wherein said drive controlling means includes:

driving current setting means for setting a driving current value of said DC motor corresponding to the opening degree difference;

determining means for determining whether or not the magnitude of the driving current value is higher than a predetermined threshold;

switching means for outputting the output voltage of said boosting means when said determining means determines that the magnitude of the driving current value is higher than the predetermined threshold, and outputting the output voltage of said DC power source when said determining means determines that the magnitude of the driving current value is lower than or equal to the predetermined threshold; and driving means for applying the output voltage of said switching means to said DC motor in a polarity direction based on whether or not the opening degree difference is positive.

3. An apparatus according to claim 1, wherein said boosting means includes a capacitor, and boosted voltage generating means for boosting the output voltage of said DC power source and applying the boosted voltage to said capacitor, and outputs a voltage between both ends of said capacitor.

4. An apparatus according to claim 3, wherein said boosting means includes boost controlling means for activating said boosted voltage generating means when the voltage between the both ends of said capacitor is lower than or equal to a threshold voltage at a case of selecting the output voltage of said DC power source.

5. An apparatus according to claim 2, wherein said driving means for applying the output voltage of said switching means to said DC motor at a duty ratio corresponding to the driving current value for each predetermined period.

6. An apparatus according to claim 1, wherein said target opening degree setting means sets the target opening degree of said throttle valve in accordance with a stepping-in amount of an accelerator pedal as the operation state of said internal combustion engine.

* * * * *